US006553870B1

(12) United States Patent
Kendall et al.

(10) Patent No.: US 6,553,870 B1
(45) Date of Patent: Apr. 29, 2003

(54) CONTAINER HOLDER WITH SINK DRAIN ATTACHMENT

(76) Inventors: Lawrence G. Kendall, 2401 Christmas Tree La. #109, Bakersfield, CA (US) 93306; Mark A. Jackson, 5188 N. Harrison Ave., Fresno, CA (US) 93711

( * ) Notice: Subject to any disclaimer, the term of this patent is extended or adjusted under 35 U.S.C. 154(b) by 20 days.

(21) Appl. No.: 09/993,409

(22) Filed: Nov. 16, 2001

Related U.S. Application Data

(60) Provisional application No. 60/249,676, filed on Nov. 17, 2000.

(51) Int. Cl.[7] ..... B67B 7/00

(52) U.S. Cl. ..... 81/3.32; 81/3.39; 81/3.09; 269/100

(58) Field of Search ..... 81/3.32, 3.39, 81/3.25, 3.4, 3.31, 3.07, 3.09; 269/95, 97, 98, 100, 48.1

(56) References Cited

U.S. PATENT DOCUMENTS 1,906,887 A * 5/1933 Rogers ..... 81/3.32
5,060,895 A * 10/1991 Stuart ..... 248/176.1
6,243,885 B1 * 6/2001 Lopez-Torres, Jr. ..... 4/300

* cited by examiner

*Primary Examiner*—Joseph J. Hail, III
*Assistant Examiner*—Hadi Shakeri
(74) *Attorney, Agent, or Firm*—Walter Unterberg

(57) ABSTRACT

This container holder is a vertical structure with its lower extremity fixedly attachable to a sink drain opening, and its upper extremity capable of receiving and clamping the container whose lid is to be manipulated. At the holder bottom, parallel connected fixed and pivoting partial cylindrical sections are placed in the sink drain opening. The user rotates a cam lever to swing out the pivoting section until the holder is firmly fixed in the sink drain. The top of the holder has a platform on which the container is placed. A screw mechanism actuated by a crank handle converges two clamping jaws around the container to fix it in place. Advantages include use of minimum force for both sink attachment and container clamping, and normal sink function with the holder in place. The holder can be made of lightweight materials, is easily cleaned and rapidly deployed.

9 Claims, 7 Drawing Sheets

CONTAINER HOLDER WITH SINK DRAIN ATTACHMENT

CROSS-REFERENCE TO RELATED APPLICATIONS

This application claims the benefit of Provisional Patent Application Ser. No. 60/249,676 filed Nov. 17, 2000.

BACKGROUND OF THE INVENTION

1. Field of the Invention

This invention relates to holders which keep containers stationary for the purpose of removing container lids. In particular, it relates to such holders which themselves are kept stationary by an attachment to a kitchen sink drain opening.

2. Related Art

Foodstuffs and other products are frequently placed in containers made of metal, glass, plastic or related materials, closed by lids which are twisted off or pried off to open the container. At the factory the lids are securely and strongly attached to the containers to seal and protect the stored product against accidental opening during transit en route to distribution points and retail outlets.

After initial detachment from their containers, most lids are designed to be re-attached to the containers by reversing the detachment motions, such as twisting on or pressing on. As the product is used up, many detach and re-attach cycles are performed by the user. However, because of the nature of manufacture, the initial detachment requires application of a large amount of force, exceeding that needed for subsequent detach efforts.

In many applications the user is able to hold the container with one hand and detach its lid with the other hand. But more often, especially when twisting off by hand, increased leverage for the twisting motion is required. Many devices exist to provide such increased leverage. Sometimes, however, increased leverage is not enough, and it must be accompanied by means to keep the container stationary, such as by clamping in a vise or equivalent.

Therefore a patent search was undertaken for container holders with features to keep them stationary. Two U.S. patents were found: U.S. Pat. No. 5,209,142 (1993) to Dickson, and U.S. Pat. No. 5,345,844 (1994) to Marsaw.

Dickson provides a holder wherein the container is clamped between V-blocks fixed to a base and a piston-like slider. The user's body weight acting on the free end of the slider provides the force to clamp the container, and further to push the far end of the base against a "stop" such as the back wall of a kitchen counter. This leaves both hands free to work on the lid of the container. The drawback of Dickson is that the weight and dimensions of the user's body must be compatible with the kitchen counter geometry to make his device work for a variety of containers.

Marsaw provides a self-contained device for the mechanical twisting off of a container lid. The device has a base which (a) houses an adjustable rotatable clamp to hold the bottom of the container, and (b) carries a vertically and horizontally adjustable clamp to hold the container lid stationary. Rotation (motorized) of the bottom of the container twists the container off the lid. Marsaw does not provide for detachment of other than screw lids, and shows a rather complicated machine which must be made of metal with close tolerances. The device must have a heavy base to fulfil its lid-detaching function.

OBJECTS OF THE INVENTION

An object of the instant holder invention is to avoid use of body force for clamping and enable detaching of container lids of all types.

Another object is to make use of a fixed structure available in the home to keep the holder stationary without affecting the normal use of such a structure.

A further object is a holder capable of clamping containers of various sizes and shapes, leaving the user's hands free to manipulate container lids.

Yet another object is to provide an inexpensive lightweight device which is simple to operate and easy to clean.

SUMMARY OF THE INVENTION

To implement the Objects stated above, the instant invention of a Container Holder with Sink Drain Attachment was devised. The basic concept is an essentially vertical structure with its lower extremity fixedly attachable to a sink drain opening as normally found in residential kitchens, and its upper extremity capable of receiving and clamping the container whose lid is to be removed or affixed. The components of the Holder can be made of plastic material formed by the injection molding process, by metal casting, or by machining of various metallic, plastic or organic materials.

The essentially vertical Holder of the invention has a main body with a thin-walled hollow cylindrical base section which extends down into the sink drain opening, and two parallel columns which rise from the base section to support a circular horizontal container positioning surface on which the container of interest is placed. The next paragraphs detail the attachment of the Holder to the sink drain opening and the clamping of the container on the positioning surface.

The upper extremity of the main body base section is a horizontal partial annular plate which is placed concentrically in contact with the top of the circular sink drain opening. The lower portion of the main body base section is parallel to the curved base section of a pivoting lower half, also having a horizontal partial annular plate, which can be swung horizontally toward and away from the main body base section. Thus the two base sections combine to create a variable size pipe-like funnel extending from the combined horizontal partial annular plates into the sink drain opening. The structure to achieve this is now described.

The pivoting lower half has two short shafts rising vertically upward from its horizontal partial annular plate. One of them, the pivot shaft, serves to pivotally attach the pivoting lower half to the main body base section. The other, the cam lever pivot shaft, serves as the pivot for a cam lever which has an eccentric cam surface in contact with a cam surface on the main body.

By rotating the cam lever the eccentric cam surface on the cam lever is moved along the main body cam surface and the pivoting lower half rotates about the pivot shaft. In one extreme position the pipe-like funnel size is a minimum for insertion in the sink drain opening. Then the cam lever is rotated to expand the funnel to fit tightly in the sink drain opening to attach the Holder. The dimensions are selected to provide a large mechanical advantage for the attach motion.

The container placed on the positioning surface is clamped to the Holder by means of two equal and opposite curved clamping jaws integral with slanted bearing surfaces which encase female thread contours. The female thread contours of both clamping jaws ride on a horizontal screw shaft with matching male threads. The shaft is located in a longitudinal groove cut in the positioning surface. The groove cross-section matches the slanted bearing surfaces of the clamping jaws. One jaw and its adjacent half-shaft carry right-hand threads, while the other jaw and half-shaft carry left-hand threads. A central positioning slot restrains longitudinal shaft motion. When the shaft is rotated by an attached crank handle, the clamping jaws symmetrically move farther apart or closer together depending on the direction of shaft rotation. Thus the jaws can be made to converge on the container and clamp it to the Holder. Again, this shaft and screw arrangement provides a large mechanical advantage for the user.

The advantages of the Holder of this invention include:

1. Use of minimum body or manual force by the user for (a) the attachment of the Holder to the sink drain and (b) the clamping of the container to the Holder, both manipulations being accomplished with a large mechanical advantage, in (a) by rotation of the cam lever and in (b) by rotation of the threaded shaft;
2. Ability to accommodate basic cylindrical containers 2 or more inches in height and typically 1 to 5.5 inches in diameter, also with container perimeters of any regular polygonal shape, and a variety of lid designs, such as twistoff, fliptop, and childproof;
3. Normal sink operation with the Holder installed, including easy mitigation of any spills from the container during lid manipulation or otherwise; and
4. Convenient handling characteristics of the Holder which is lightweight, rapidly installed and removed, and easily cleaned.

BRIEF DESCRIPTION OF THE SEVERAL VIEWS OF THE DRAWING

FIG. 1A shows the holder prior to insertion in the sink drain opening. FIG. 1B shows the bottom of the holder inserted in and rigidly fixed to the sink drain opening. FIG. 1C shows the fixed holder with the closed container clamped to the top of the holder: and FIG. 1D shows the lid removed from the now open container.

DETAILED DESCRIPTION OF THE INVENTION

Referring now to FIGS. 1A–1D, the container holder of the invention is shown generally at 100. These figures will be described in detail in the Operation section under this heading.

Figure 1D:
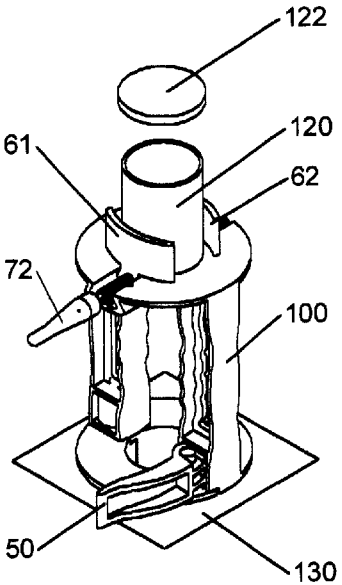
FIGS. 1A–1D are pictorial views showing the container holder of the invention in successive stages of deployment.
Figure 1C:
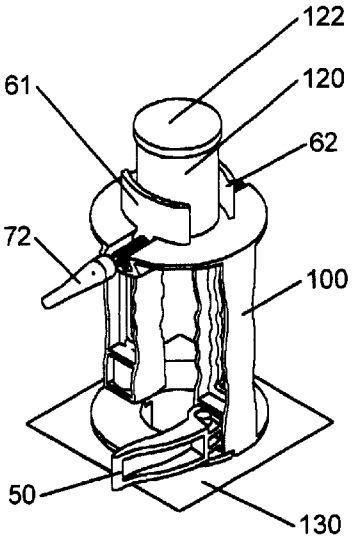
Figure 1B:
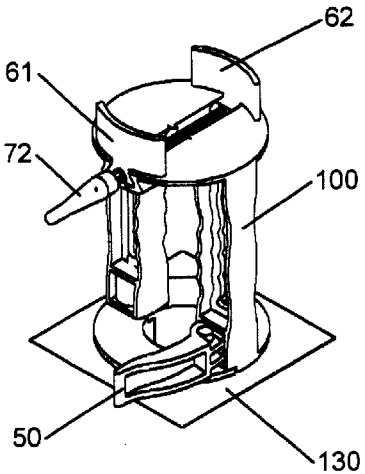
Figure 1A:
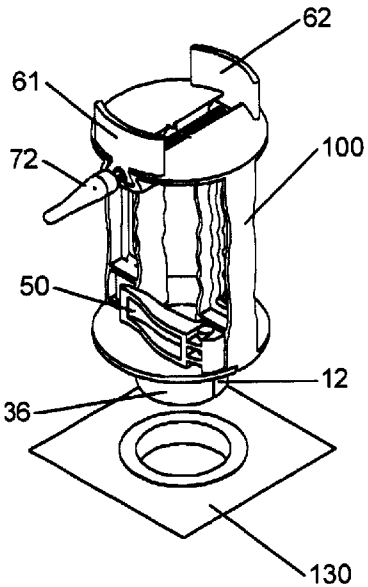
Figure 2B:
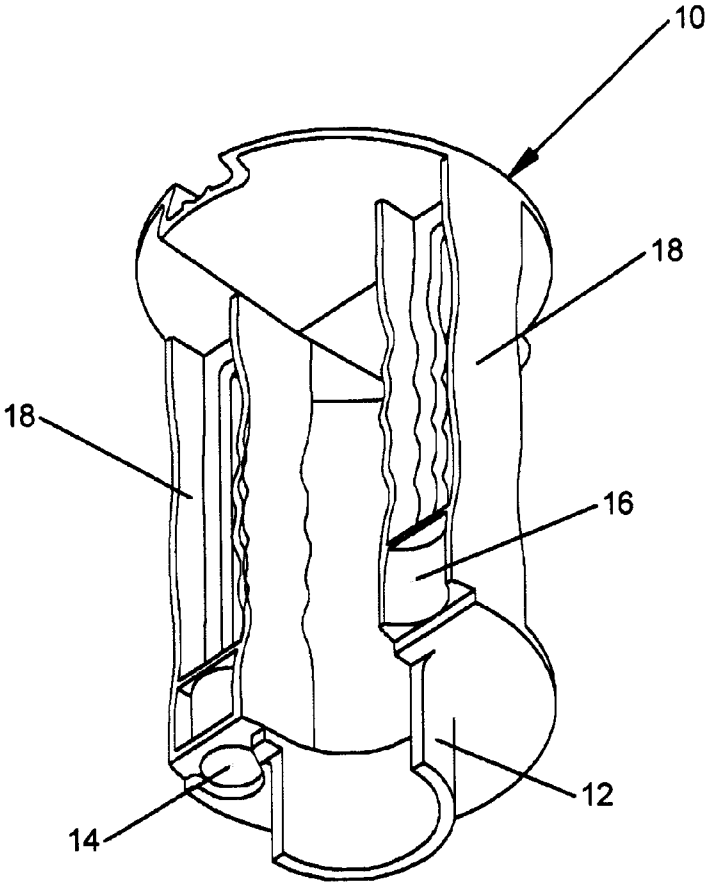
FIGS. 2A and 2B are breakaway pictorial views showing the main body of the holder from above and from below.
Figure 2A:
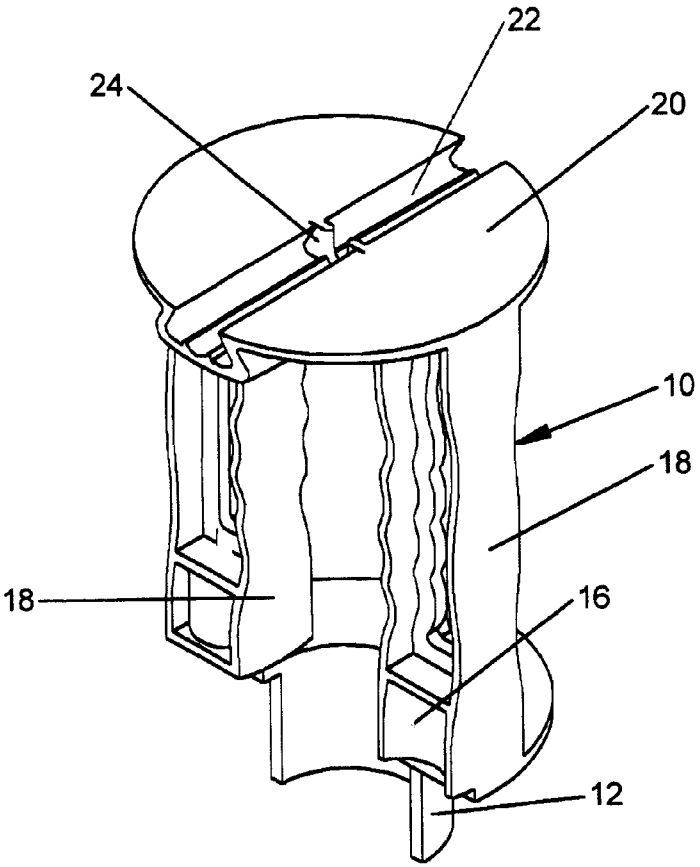

Referring now to FIGS. 2A and 2B, the main body 10 of holder 100 comprises an essentially vertical cylindrical thin-walled base section 12, a cylindrical pivot opening 14, an essentially cylindrical cam surface 16, and two essentially vertical columns 18. Columns 18 support an essentially flat and horizontal container positioning surface 20 and an essentially horizontal contoured clamping jaws groove 22 housing a positioning slot 24.

Figure 3:
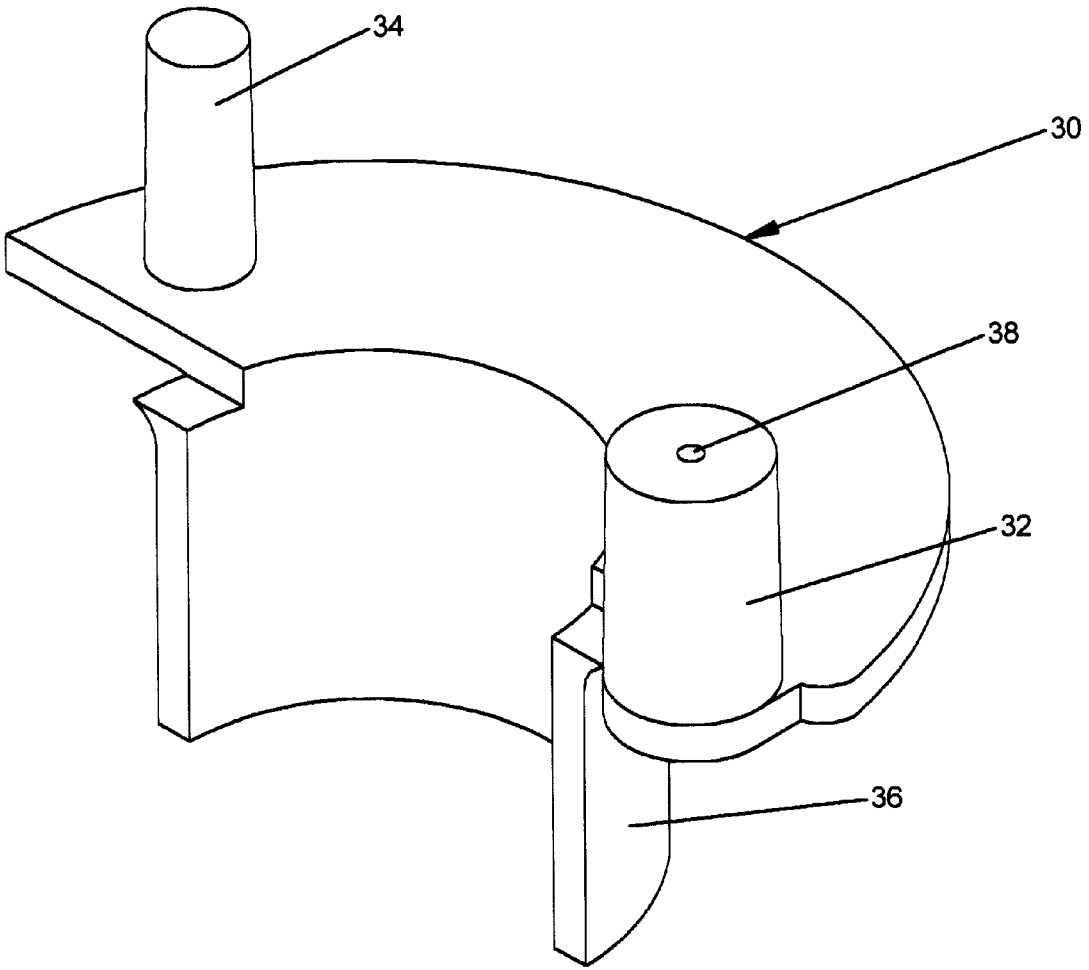
FIG. 3 is an isometric view of the pivoting lower half of the holder.

Referring now to FIG. 3, the pivoting lower half 30 of holder 100 comprises an essentially vertical and cylindrical pivot shaft 32, a cylindrical cam lever pivot shaft 34, and an essentially vertical and cylindrical thin-walled base section 36. The distal end of pivot shaft 32 has an essentially vertical fastener hole 38.

Figure 4B:
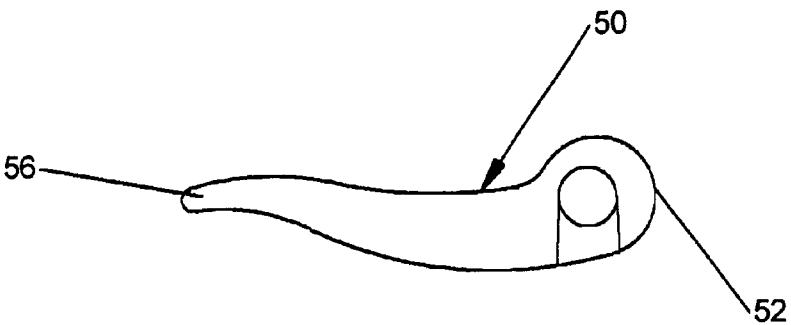
FIGS. 4A and 4B are an isometric view and a plan view of a cam lever which fixes the holder in the sink drain opening.
Figure 4A:
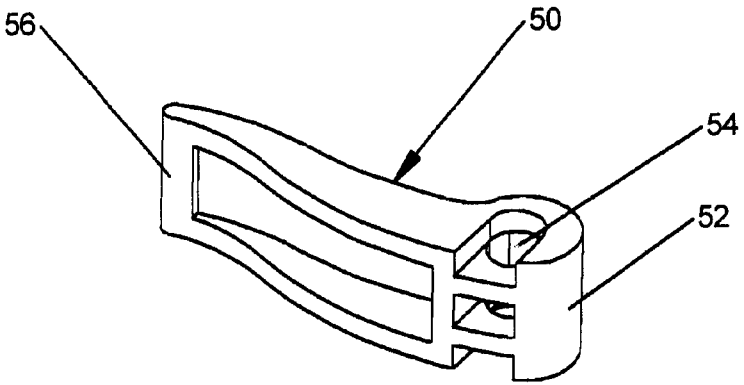

Referring now to FIGS. 4A and 4B, the cam lever 50 comprises an essentially vertical and cylindrical pivot hole 54, an essentially vertical eccentric cam surface 52 and a cam lever handle 56. The distance from cam lever pivot hole 54 to cam surface 52 is variable, being smallest at a point on cam surface 52 located adjacent to lever handle 56, and greatest at a point on cam surface 52 located opposite lever handle 56. In addition, the distance from the distal end of handle 56 to the centerline of pivot hole 54 is substantially greater than the distance from the centerline of pivot hole 54 to any point along eccentric cam surface 52.

Figure 5B:
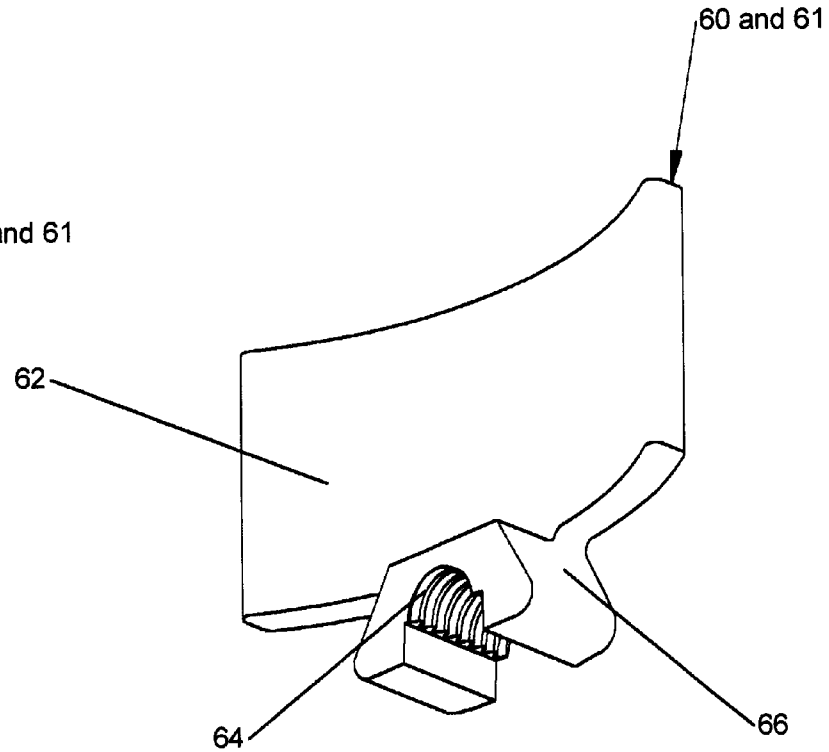
FIGS. 5A and 5B are pictorial views of a right-hand container clamping jaw and a left-hand container clamping jaw, respectively.
Figure 5A:
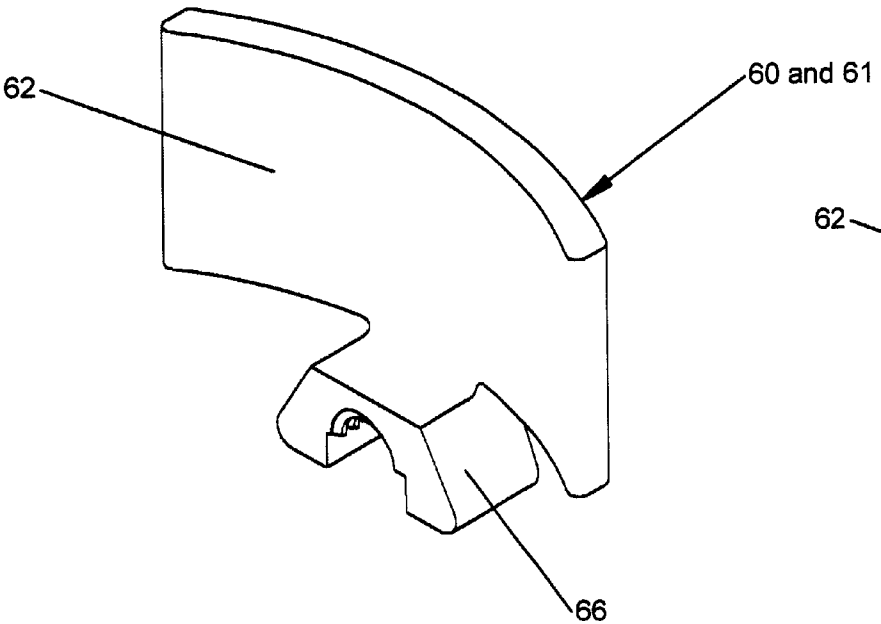

Referring now to FIGS. 5A and 5B, the right-hand clamping jaw 60 and the left-hand clamping jaw 61 each comprise a jaw surface 62, a slanted bearing surface 66 and a female thread contour 64. Jaw surface 62 is an essentially vertical cylindrical thin-walled sector of a circle. Contour 64 has a right-hand thread configuration for jaw 60, and a left-hand thread configuration for jaw 61.

Figure 6:
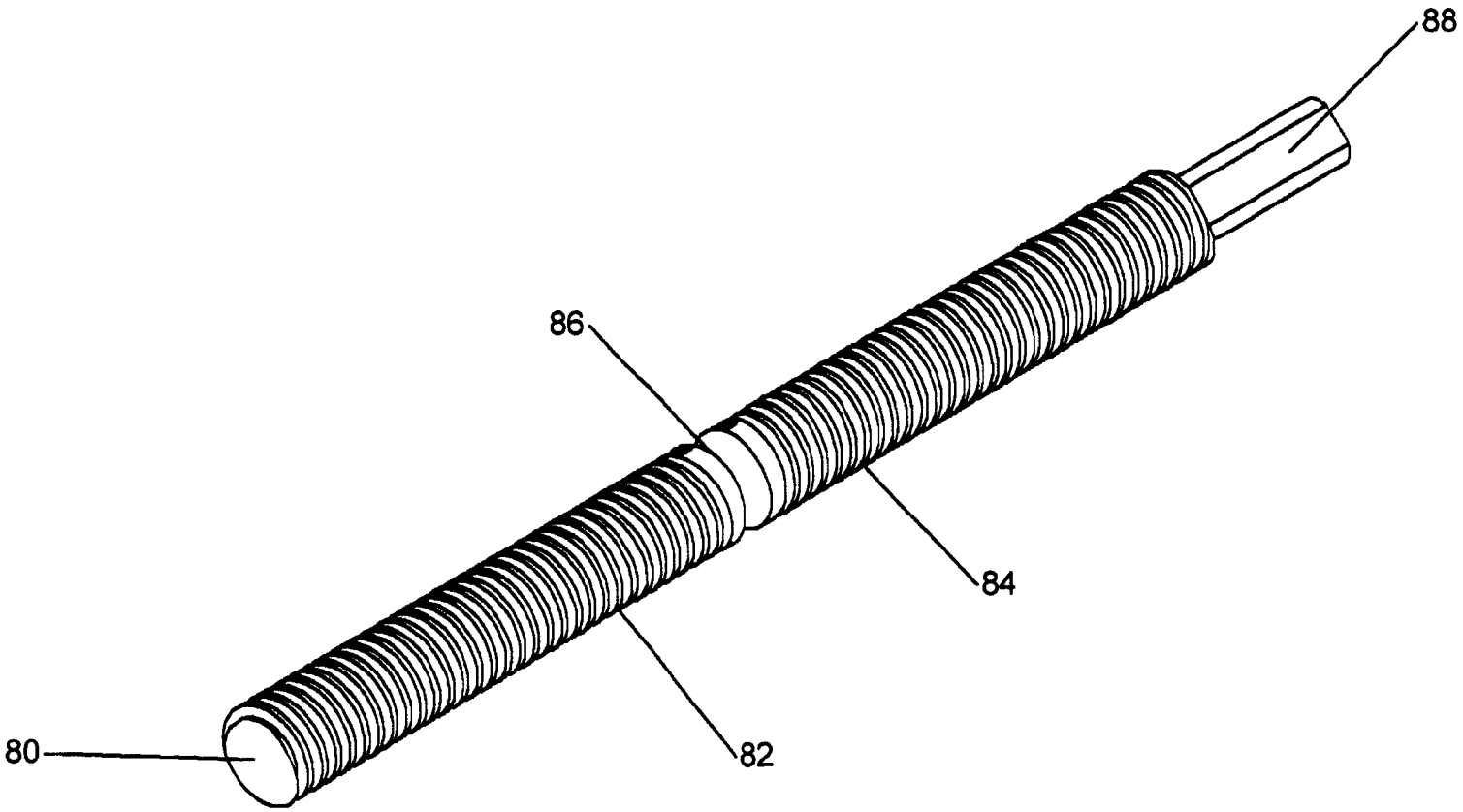
FIG. 6 is an isometric view of the holder screw shaft which actuates the clamping jaws of FIG. 5. Lastly.

Referring now to FIG. 6, screw shaft 80 of the container holder comprises a right-hand screw thread 82, a left-hand screw thread 84, a positioning groove 86, and a crank lever attachment shaft 88. Screw thread 82 has a pitch and geometry similar to those of female thread contour 64 of right-hand clamping jaw 60 for screw threads 82 and 64 to form a freely engaging combination. Screw thread 84 has a pitch and geometry similar to those of female thread contour 64 of left-hand clamping jaw 61 for screw threads 84 and 61 to form a freely engaging combination.

Figure 7:
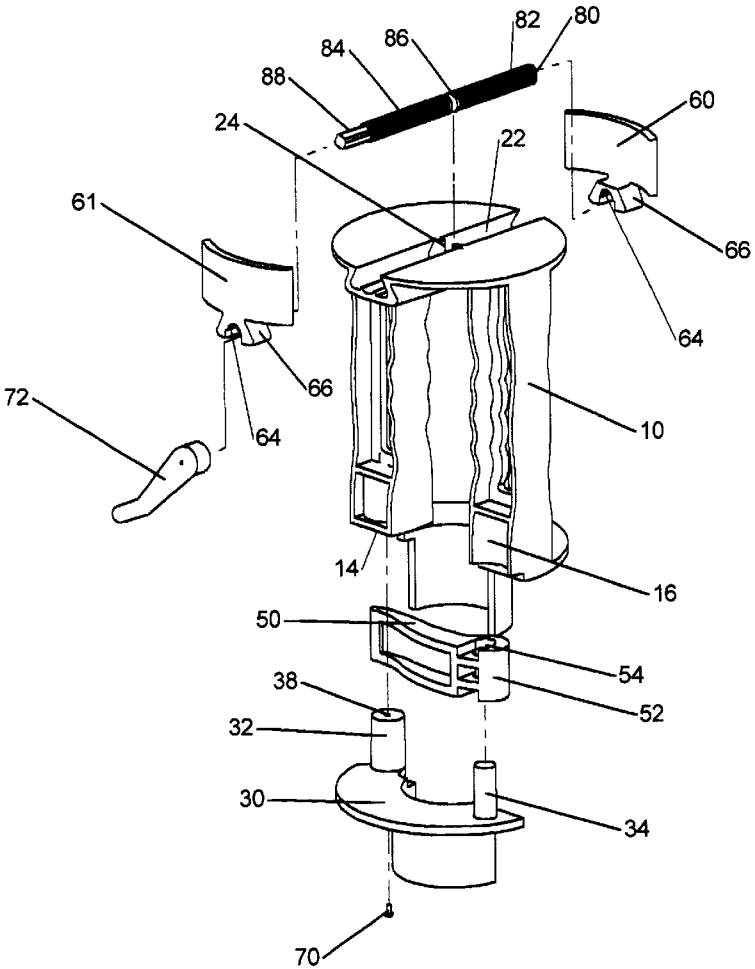
FIG. 7 is an exploded view of the main holder components to illustrate the assembly of the holder.

Referring now to FIG. 7, the assembly of container holder 100 is illustrated in terms of sequential assembly operations. Cam lever 50 is attached to pivoting lower half 30 by slipping cam lever pivot hole 54 over cam lever pivot shaft 34. Pivoting lower half 30 is attached to main body 10 by inserting pivot shaft 32 into pivot opening 14. Pivoting lower half 30 is positioned such that eccentric cam surface 52 is adjacent to cam surface 16. A screw fastener 70 is inserted through screw fastener hole 38 and screwed into the base of main body 10.

Screw shaft 80 is placed into contoured groove 22 such that positioning groove 86 is located within positioning slot 24. Female thread contour 64 of right-hand clamping jaw 60 is placed at the extremity of right-hand screw thread 82. Female thread contour 64 of left-hand clamping jaw 61 is placed at the extremity of left-hand screw thread 84. Screw shaft 80 is rotated to feed clamping jaws 60 and 61 simultaneously onto the screw threads of screw shaft 80. The geometry of the cross section of slanted bearing surface 66 for both jaws 60 and 61 is similar to the geometry of contoured clamping jaws groove 22, which therefore prevents jaws 60 and 61 from rotating about the longitudinal axis of screw shaft 80. Lastly, crank handle 72 is attached to crank lever attachment shaft 88.

Materials and Construction of Components

The components of container holder 100 are preferably of plastic material formed by means of the injection molding process. Alternatively, the components can be constructed by other means including metal casting, and machining of various metallic, plastic or organic materials. In the case of female thread contour 64, only half the complete thread form is produced to aid in the manufacture of other components by means of the injection molding process.

Operation of Container Holder

Referring now to FIGS. 1A–1D, the operation of the Container Holder of the invention is illustrated. Briefly described from the standpoint of the user, base section 12 of main body 10, and pivoting lower half 36 are placed in a typical sink drain opening indicated at 130. Cam lever 50 is rotated to rigidly fix container holder 100 in place in sink drain opening 130. The container to be held, indicated at 120, is then placed in the center of container support surface 20. Next, crank handle 72 is rotated to converge clamping jaws 60 and 61 around container 120 until it is rigidly held in place. The user may then remove or replace the container lid, indicated at 122, with respect to container 120.

Essentially only two main tasks are performed by the user: fixing the holder in the sink drain opening by cam lever rotation, and clamping the container in the holder by crank handle rotation. To enable these simple main tasks, certain settings of key components of the holder must first be carried out, to set in motion a series of kinematic processes comprising the main tasks.

First, cam 50 is positioned to bring the section of eccentric cam surface 52 of main body 10 which is perpendicular to cam lever handle 56 in contact with cam surface 16 of main body 10. With cam lever 50 in this position, the perimeter created by main body base section 12 and lower half 36 is a minimum to allow the user to place holder 100 via elements 12 and 36 into sink drain opening 130.

Next, cam lever 50 is pivoted around pivot shaft 32, moving eccentric cam surface 52 along cam surface 16 and, further, causing lower half 30 to rotate about pivot shaft 32. These motions result from the fact that the distance from the centerline of cam lever pivot hole 54 to eccentric cam surface 52 increases when moving from points adjacent to handle 56 to points opposite handle 56.

The net result is an increase in the outer perimeter created by main body base section 12 and lower half 36, expanding to fit tightly within sink drain opening 130. The distance from the distal end of cam lever handle 56 to the centerline of cam lever pivot hole 54 is substantially greater than the distance from the centerline of cam lever pilot hole 54 to any point along eccentric cam surface 52. This creates a large mechanical advantage such that any force applied to the distal end of cam lever handle 56 is multiplied several fold when reacted against any point along eccentric cam surface 52.

Now container 120 is placed on the center of container support surface 20. As previously described, clamping jaws 60 and 61 are restrained from rotating within contoured groove 22. Also, shaft 80 is restrained from moving in a longitudinal direction because its positioning groove 86 is positioned within positioning slot 24. As the user rotates crank handle 72, the threaded ends of shaft 80 engage the respective threaded contours 64 of jaws 60 and 61. Because shaft 80 is restrained from longitudinal motion, clamping jaws 60 and 61 are forced to move within contoured groove 22 and simultaneously converge around container 120 to hold it rigidly in place.

Now the user can manipulate container lid 122 as needed. Holder 100 may be left in place in sink drain opening 130 without impairing the normal utility of sink drain opening 130. The inside surface of main body base section 12 and lower half 36 essentially constitute a pipe open at both ends, permitting water or other matter to be placed down sink drain opening 130 as before.

One typical Holder design provides jaw motion to hold containers between 1 and 5.5 inches in diameter and 2 or more inches in height.

It is to be understood that the invention may be realized with embodiments differing from the specific apparatus illustrated herein without departing from the scope of the present invention as delineated in the following claims.

We claim:

1. A container holder with sink drain attachment to enable a user to immobilize a container with lid closure for the purpose of manipulating a lid of said container, said holder comprising:

an essentially vertical main body;

an attach means for rigidly attaching a lower portion of said main body to a sink drain opening; and a container clamping means to secure a container with lid closure to an upper portion of said main body;

whereby the combination in series of said sink drain opening, said attach means, said main body, said container clamping means and said container provides a rigid vertical structure culminating in a desired immobilized said container.

2. The holder of claim 1 wherein said main body lower portion comprises a cylindrical main body base section, a cylindrical pivot opening and a cylindrical cam surface; and said attach means comprise a pivoting lower half having a pivot shaft, a cam lever pivot shaft and a cylindrical pivoting base section; and a cam lever having a pivot hole, an eccentric cam surface, and a cam lever handle.

3. The holder of claim 1 wherein said main body upper portion comprises an essentially flat horizontal container positioning surface traversed by a clamping jaws groove housing a positioning slot; and said clamping means comprise a pair of equal and opposite clamping jaws, each said clamping jaw having an inward curved jaw surface, a slanted bearing surface matching the geometry of said clamping jaws groove, and a female screw thread contour, with one clamping jaw having a right-hand thread contour and another clamping jaw having a left-hand thread contour; and a screw shaft of the same length as said clamping jaws with male screw threads matching said female screw threads of said pair of clamping jaws thread contours, with one half said screw shaft having right-hand threads and another half having left-hand threads, the shaft halves being separated by a positioning groove, said screw shaft having a provision for attaching a crank handle at one shaft end.

4. The holder of claim 1 wherein said main body comprises said lower portion and said upper portion connected to said lower portion by a number of essentially vertical columns.

5. The holder of claim 4 wherein the number of said columns is two.

6. The holder of claim 1 designed to immobilize said containers having diameters in the range from one to five-and-a-half inches, and having a height of two or more inches.

7. The holder of claim 1 fabricated by a method selected from the group consisting of plastic injection molding, metal casting, and machining of various metallic, plastic and organic materials.

8. A method for assembling an attach means of a container holder to a lower portion of a main body of said container holder to form a combination and for rigidly attaching said combination to a sink drain opening, wherein the container holder has an essentially vertical main body and said lower portion has a cylindrical main body base section, a cylindrical pivot opening and a cylindrical cam surface, said container holder further includes a container clamping means to secure a container with lid closure to an upper portion of said main body; and said attach means includes a pivoting lower half having a pivot shaft, a cam lever pivot shaft and a cylindrical pivoting base section; said attach means further includes a cam lever having a pivot hole, an eccentric cam surface, and a cam lever handle; said method comprising the steps of:

attaching said cam lever to said pivoting lower half by inserting said cam lever pivot shaft in said cam lever pivot hole;

attaching said pivoting lower half to said main body base section by inserting said pivot shaft into said pivot shaft opening, with said eccentric cam surface contacting said main body cam surface;

placing the combination of said main body base section and said pivoting base section into said sink drain opening; and rotating said cam lever to expend a combined perimeter of said combination to fit tightly in said sink drain opening.

9. A method for assembling a clamping means of a container holder to an upper portion of a main body of said container holder to form a combination and for using said combination to immobilize a container with lid closure, wherein the container holder has an essentially vertical main body and said upper portion has an essentially flat horizontal container positioning surface traversed by a clamping jaws groove housing a positioning slot; said container holder further includes an attach means for rigidly attaching a lower portion of said main body to a skin drain opening; and said clamping means includes a pair of equal and opposite clamping jaws, each said clamping jaw having an inward curved jaw surface, a slanted bearing surface matching the geometry of said clamping jaws groove, and a female screw thread contour, with one clamping jaw having a right-hand thread contour and another clamping jaw having a left-hand thread contour; said clamping means further includes a screw shaft of the same length as said clamping jaw groove, with male screw threads matching said female screw threads of said pair of clamping jaws thread contours, with one half said screw shaft having right-hand threads and another half having left-hand threads, the shaft halves being separated by a positioning groove, said screw shaft having a provision for attaching a crank handle at one shaft end; said method comprising the steps of:

placing said screw shaft into said contoured groove with said shaft positioning groove located within said groove positioning slots;

placing said pair of clamping jaws at extremities of said screw shaft, with said left-hand female screw threads contour placed at said left-hand male thread shaft extremity, and said right-hand female screw thread contour placed at said right-hand male thread shaft extremity;

rotating said screw shaft to feed said clamping jaws simultaneously onto said male threads of said screw shaft, at the same time advancing said clamping jaws slanted bearing surfaces within said clamping jaws groove;

attaching said crank handle to said one shaft end and placing said container on a center of said container positioning surface; and rotating said crank handle to rotate said screw shaft to converge said clamping jaws around said container until said container is immobilized in place.

* * * * *